United States Patent [19]

Van Siclen, Jr.

[11] 4,232,647

[45] Nov. 11, 1980

[54] CONTROL CIRCUIT FOR DIESEL INJECTION SYSTEM

[75] Inventor: Howard E. Van Siclen, Jr., Sidney, N.Y.

[73] Assignee: The Bendix Corporation, Southfield, Mich.

[21] Appl. No.: 960,513

[22] Filed: Nov. 13, 1978

[51] Int. Cl.[3] ..... F02D 5/02

[52] U.S. Cl. ..... 123/478; 123/350; 123/483; 123/484

[58] Field of Search ..... 123/32 EA, 32 AE, 32 AB, 123/102

[56] References Cited

U.S. PATENT DOCUMENTS

| | | | |
|---|---|---|---|
| 3,106,196 | 10/1963 | Woodward et al. | 123/32 EA |
| 3,587,535 | 6/1971 | Kimberley et al. | 123/32 AE |
| 3,653,365 | 4/1972 | Monpetit | 123/32 EA |
| 3,659,571 | 5/1972 | Lang | 123/102 |
| 3,685,526 | 8/1972 | Hobo et al. | 123/32 EA |
| 3,693,603 | 9/1972 | Lemanczyk | 123/32 EA |
| 3,731,664 | 5/1973 | Tsuzuki et al. | 123/102 |
| 3,800,749 | 4/1974 | Advenier | 123/32 EA |
| 4,084,552 | 4/1978 | Drews et al. | 123/32 EA |
| 4,134,367 | 1/1979 | Ferry et al. | 123/32 EA |

*Primary Examiner*—Charles J. Myhre
*Assistant Examiner*—Andrew M. Dolinar
*Attorney, Agent, or Firm*—Raymond J. Eifler

[57] ABSTRACT

A fuel control system for an electronically controlled fuel injected internal combustion engine, whereby fuel is injected into the cylinders for a fixed number of degrees with respect to the crankshaft rotation. A trigger pulse is fed into a tachometer circuit (32) giving a DC ramp output with respect to speed. A portion of this ramp signal is fed into a monostable circuit (31) whose output pulse duration is now speed dependent and remains constant in degrees of engine crankshaft as the speed of the crankshaft increases. By adjusting the slope of DC ramp output fed into the monostable circuit (31), the fuel "on" time may be set to any fixed number of engine crankshaft degrees desired for a particular engine.

21 Claims, 16 Drawing Figures

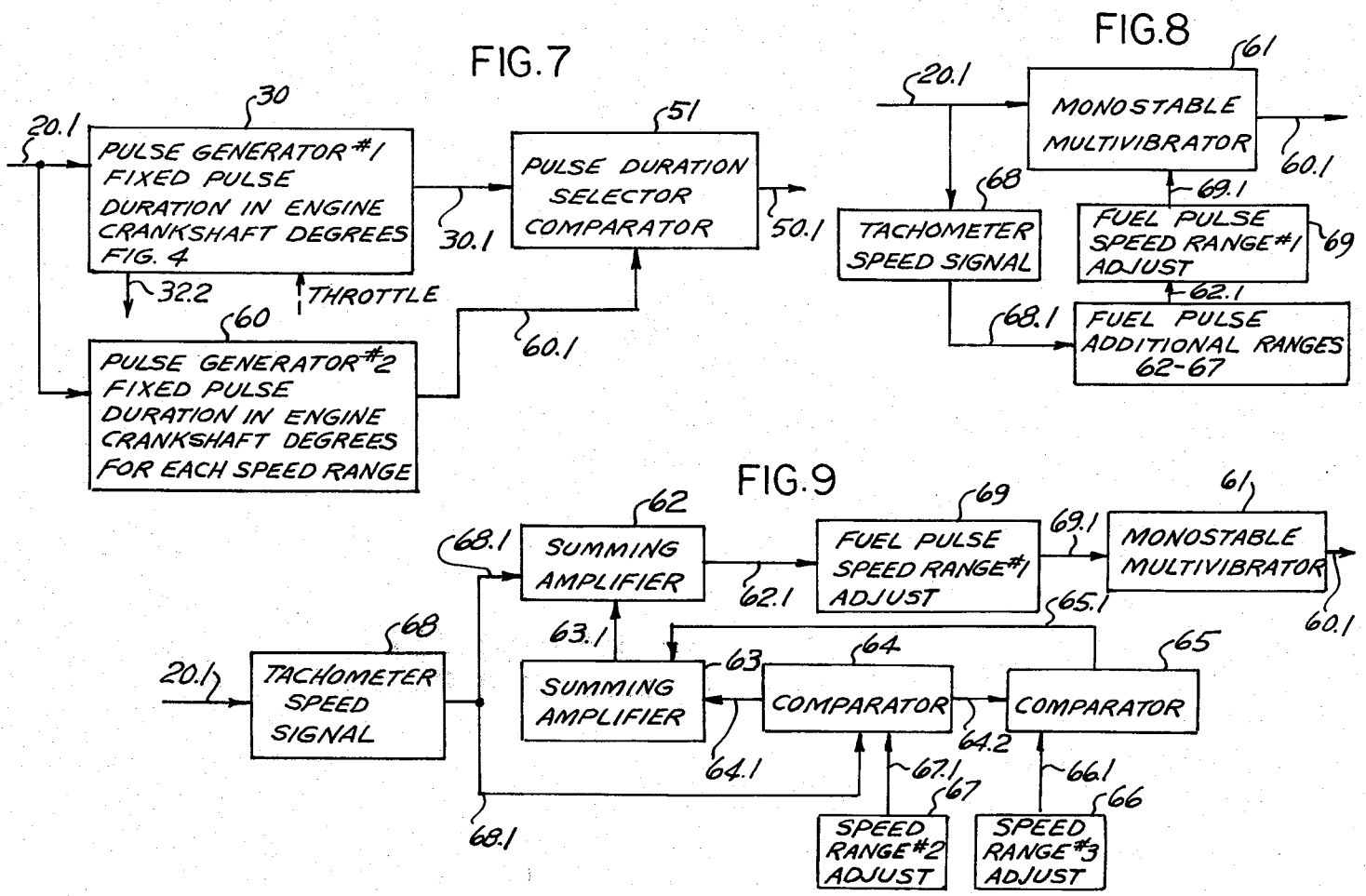
FIG.8
MONOSTABLE MULTIVIBRATOR
FUEL PULSE SPEED RANGE #1 ADJUST
FUEL PULSE ADDITIONAL RANGES 62-67
TACHOMETER SPEED SIGNAL
FIG.7
PULSE GENERATOR #1 FIXED PULSE DURATION IN ENGINE CRANKSHAFT DEGREES FIG. 4
PULSE GENERATOR #2 FIXED PULSE DURATION IN ENGINE CRANKSHAFT DEGREES FOR EACH SPEED RANGE
PULSE DURATION SELECTOR COMPARATOR
THROTTLE
FIG.9
MONOSTABLE MULTIVIBRATOR
FUEL PULSE SPEED RANGE #1 ADJUST
SUMMING AMPLIFIER
SUMMING AMPLIFIER
COMPARATOR
COMPARATOR
SPEED RANGE #2 ADJUST
SPEED RANGE #3 ADJUST
TACHOMETER SPEED SIGNAL

FUEL ON TIME MILLISECONDS
RPM
L1
L2
A
X

FUEL ON TIME MILLISECONDS
RPM
L1
A
B
C
X
Y

FUEL ON TIME CRANKSHAFT DEGREES
RPM
L1
L2
L3
A1
(35)
(37)
X

FUEL ON TIME CRANKSHAFT DEGREES
RPM
E
A1
B1
C1
X
Y

CONTROL CIRCUIT FOR DIESEL INJECTION SYSTEM

FIELD OF THE INVENTION

This invention is directed to the field of fuel control for an internal combustion engine and has particular utility with respect to a diesel engine.

BACKGROUND OF THE INVENTION

The diesel or high compression ignition internal combustion engine in common usage presently is usually mechanically operated from the governor to the rack mechanism which controls the amount of fuel injected to the cylinders. Recent electrical or electronic systems utilized in several diesel engines have been constant pressure devices where an electrical pulse actuates a solenoid valve which allows the constant pressure to force fuel into the cylinder as long as the solenoid was activated. However, most present systems utilize a jerk pump injector which mechanically operates from a push rod whereby pressure varies with speed as does the time of injection. Since the use of a jerk pump injector for fuel injection is more accurate for injecting the fuel than are the constant pressure devices, the present invention substitutes an electronic control of a spill valve for the mechanical rack control but retains the jerk pump for pressure control.

Although electronic control systems for fuel injection systems are quite common in the prior art, the majority of these systems control the fuel pulse duration as a function of time and not a specific number of degrees per engine revolution. Representative of the stateof-the-art are U.S. Pat. Nos. 3,653,365 to Monpetit; 3,659,571 to Lang and 3,800,749 to Advenier. The patent to Monpetit describes an electronic control system for a diesel engine whereby the system is controlled by the rotation of the engine providing a sawtooth wave, the slope of which is dependent upon the speed of rotation.

The patent to Lang shows an electronic speed regulating arrangement for diesel engines whereby input pulses are produced having a duration which is made variable corresponding to a predetermined speed-load characteristic of the engine. Input pulses from a monostable multivibrator have a duration which is a function of the speed of the engine. These input pulses, along with a secured set of pulses having a duration as a function of the state of the injector valve, are fed to a comparator and are made variable corresponding to a predetermined speed-load characteristic. The patent to Advenier teaches an apparatus for regulating the duration of a square wave signal in an electronic injection control installation for diesel engines. The circuitry includes a pulse generator slaved to the rotation of the engine for initiating each injection period and a function generator for developing a reference voltage. A rectangular delay signal is produced to develop a regulating voltage rising from zero until it corresponds to the instantaneous value of the reference voltage and then follows this value. The duration of the injection signal is a function of this regulating voltage. Each of these patents determine the fuel pulse as a function of time. Conversely, none of these patents determine the duration of the fuel pulse for a diesel or spark ignition internal combustion engine as a function of the amount of degrees of engine crankshaft rotation.

SUMMARY OF THE INVENTION

The present invention is characterized by a fuel control system for an electronically controlled fuel injected internal combustion engine, whereby fuel is injected into the cylinders for a fixed number of degrees of engine crankshaft rotation. The invention is further characterized by a tachometer circuit (32) which provides a DC ramp output with respect to speed to a monostable multivibrator circuit (31) whose output pulse duration is now speed dependent and is fixed in degrees of engine crankshaft rotation as the engine crankshaft speed increases. Therefore, by adjusting the amount of current (slope) fed into the monostable circuit, the fuel "on" time may be set to a fixed number of degrees of engine crankshaft rotation.

Accordingly, it is an object of the present invention to produce an electronic control system for an internal combustion engine in which the fuel "on" time may be set to a precise number of degrees of engine crankshaft rotation.

The above and other objects of this invention will become obvious from the following detailed description taken in conjunction with the accompanying drawings and claims which form a part of this specification.

BRIEF DESCRIPTION OF THE DRAWINGS

FIGS. 6–9 illustrate another embodiment of the invention wherein the fuel pulse duration of an engine electronic control system is equal to a fixed and different number of crankshaft degrees of rotation for each of a plurality of engine crankshaft speed ranges.

DETAILED DESCRIPTION OF THE DRAWINGS

FIGS. 1 through 5 illustrate the block diagram of an electronic control system that generates a pulse for a fuel injector solenoid which has a duration that is fixed in engine crankshaft degrees for all speeds of the engine. The details of the circuitry within these blocks will be found in FIGS. 14, 15 and 16 and the general operating characteristics of an engine under load using this electronic control system will be found in FIGS. 10 and 12.

Figure 1:
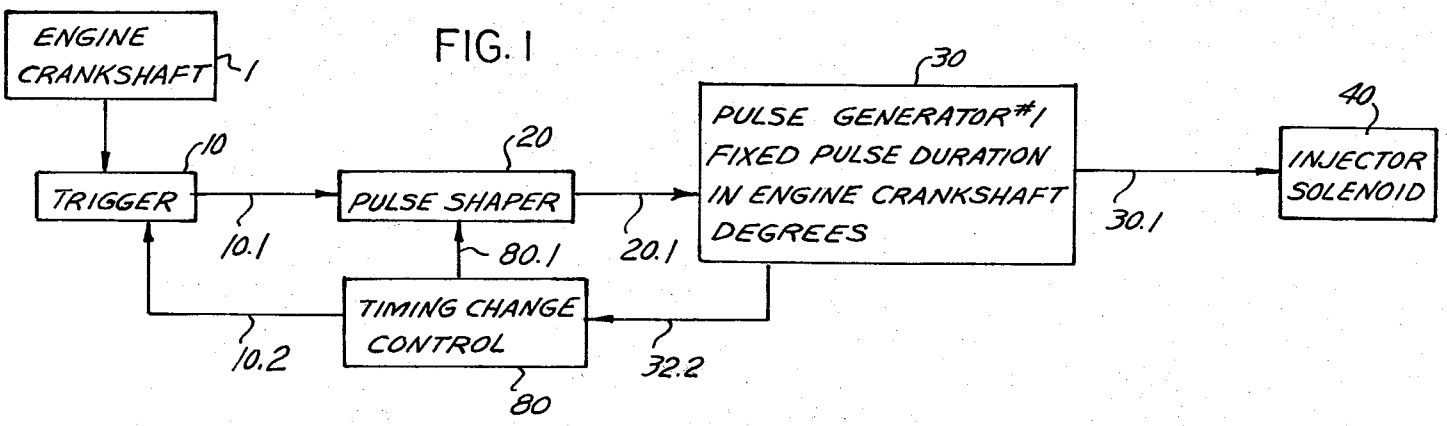
FIGS. 1–5 illustrate an embodiment of the invention wherein the fuel pulse duration of an engine electronic control system is equal to a fixed number of crankshaft degrees of rotation over an entire range of engine crankshaft speeds.

FIG. 1 illustrates a block diagram of a portion of an electronic control system for an internal combustion engine that utilizes some of the features of this invention. The electronic control system provides an electrical pulse to the circuitry that energizes the solenoid of a fuel injector. Up to a predetermined maximum speed, the pulse has a duration equal to a fixed number of degrees of engine crankshaft rotation, regardless of the speed of the crankshaft. Generally, the system is mechanically linked to an engine crankshaft or cam shaft 1 to generate a trigger signal 10.1 which is shaped by a pulse shaping circuit 20 to provide a signal 20.1 for a main pulse generator 30. The pulse generator 30 then produces a signal pulse having a duration in engine crankshaft degrees that is fixed regardless of the speed of the engine. The signal pulse 30.1 is fed to the solenoid of an injector or its energizing circuit (not shown) to open and close the injector for the duration of the pulse. In systems where there is more than one injector, a distributor (not shown) would be used to distribute respective signal pulses 30.1 to each solenoid. The function of the trigger circuit 10 is to provide a reference signal 10.1 that identifies a particular point in the rotation of the engine crankshaft (e.g., top dead center) at which a signal pulse 30.1 from the generator 30 is initiated to control the injector solenoid. The timing change control 80 allows adjustment (either manually or automatically) of the position at which a signal pulse 30.1 is initiated, e.g., before or after top dead center. In this embodiment the point at which a signal pulse 30.1 is initiated is automatically adjusted as a function of engine crankshaft rotational speed.

Figure 2:
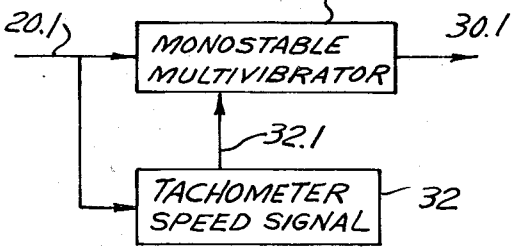

FIG. 2 illustrates a block diagram of the minimum components that comprise the pulse generator 30 shown in FIG. 1. To generate a signal pulse 30.1 having a fixed duration in engine crankshaft degrees, the timing portion of a monostable multivibrator 31 receives a crankshaft speed signal 32.1 from a tachometer 32. The signal 32.1 is then fed into the timing section of the monostable multivibrator to produce a pulse, the duration of which is fixed in engine crankshaft degrees regardless of the speed of the engine.

Figure 3:
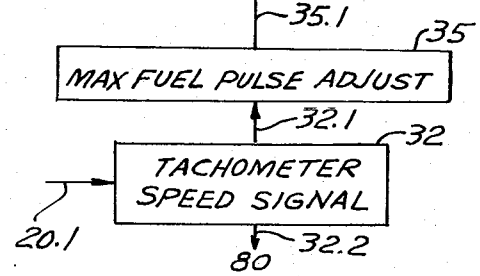
Figures 10, 11, 12, 13:
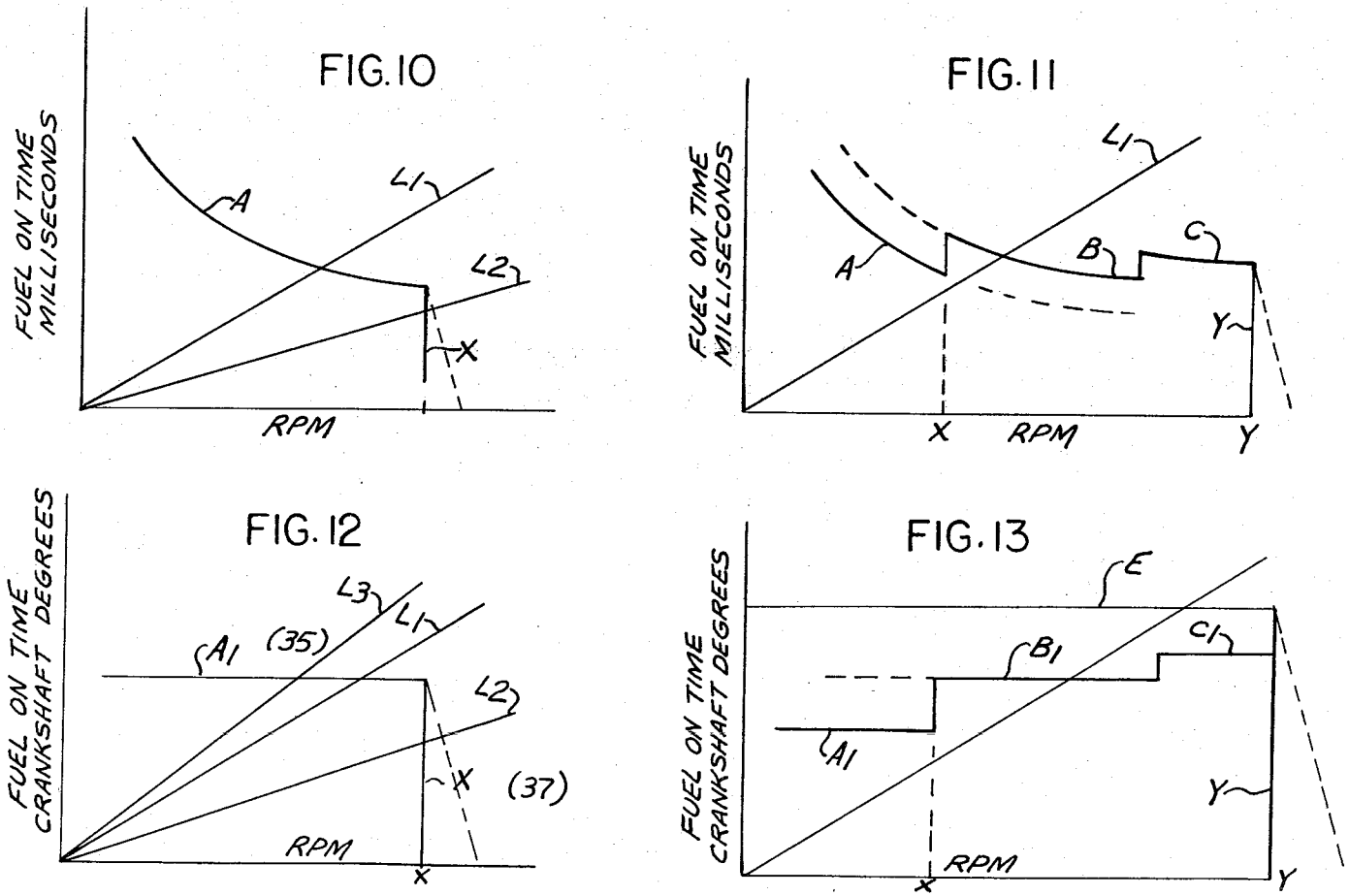
FIGS. 10 and 12 illustrate the operating characteristics of the electronic control system shown in FIGS. 1–5.
FIGS. 11 and 13 illustrate the operating characteristics of the electronic control systems shown in FIGS. 6–9.

FIG. 3 is a block diagram that illustrates how the invention may be used with more than one type of internal combustion engine by adding circuitry that allows for adjustment of the fixed number of engine crankshaft degrees of the pulse signal 30.1 for a particular engine (raising and lowering Curve A1, FIG. 12). The circuit that accomplishes this function is located between the tachometer speed signal generator 32 and monostable multivibrator 31. Accordingly, an adjustment may be made to provide a pulse 30.1 always having a duration of 10 degrees of crankshaft rotation for one engine and for another engine an adjustment may be made to the circuit so that the signal pulse 30.1 is always 12 degrees of engine crankshaft rotation. This is desirable because different engines have different operating requirements.

Figure 4:
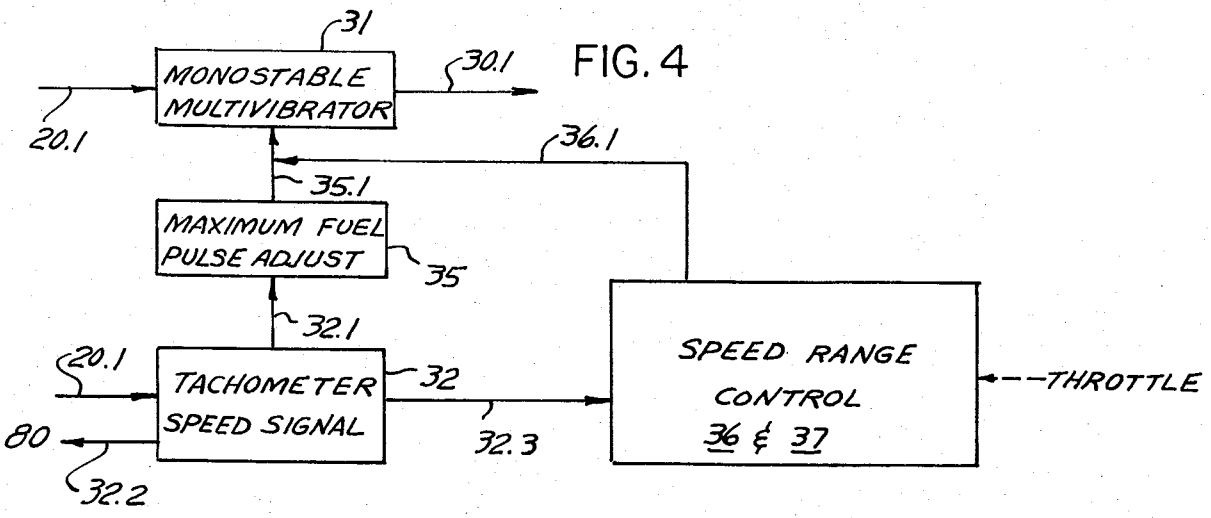

FIG. 4 illustrates a block diagram that adds further features to the system shown in FIG. 1. Specifically, the system illustrated in FIG. 4 discloses a speed range control unit which adds (1) a throttle to permit an operator to change the speed of the engine manually; and (2) and adjustable maximum speed limit, which prevents the engine crankshaft speed from exceeding a predetermined maximum speed (Moving Curve X, FIG. 12 to the left or right).

Figure 5:
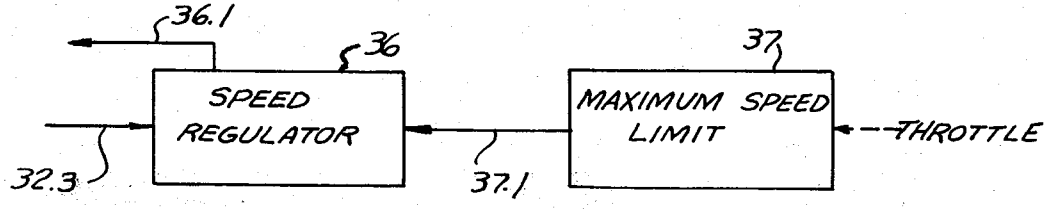

FIG. 5 illustrates in block diagram form the components of the speed range control shown in FIG. 4. The speed range control generally includes a maximum speed regulator or comparator 36 which receives a signal 37.1 from the maximum speed limit circuitry 37 and the throttle controlled by the engine operator. The maximum fuel pulse adjust 35 determines the duration of the fuel pulse in engine crankshaft degrees. The speed range control 36, 37 provides a maximum speed limit signal 36.1 which determines the maximum speed or end point of the range within which the operator commands will operate. For instance, the operator moving the throttle in and out will change the speed of the engine crankshaft but the operator cannot exceed the maximum speed determined by the speed range control circuitry 36, 37.

FIGS. 6–9 illustrate block diagrams of an electronic control system that generates a pulse for a fuel injector solenoid which has a duration that is different and fixed in engine crankshaft degrees for each of a plurality of engine speed ranges. The details of the circuitry will be found in FIGS. 14, 15 and 16 and the general operating characteristics of an engine under load using this electronic control system will be found in FIGS. 11 and 13.

Figure 6:
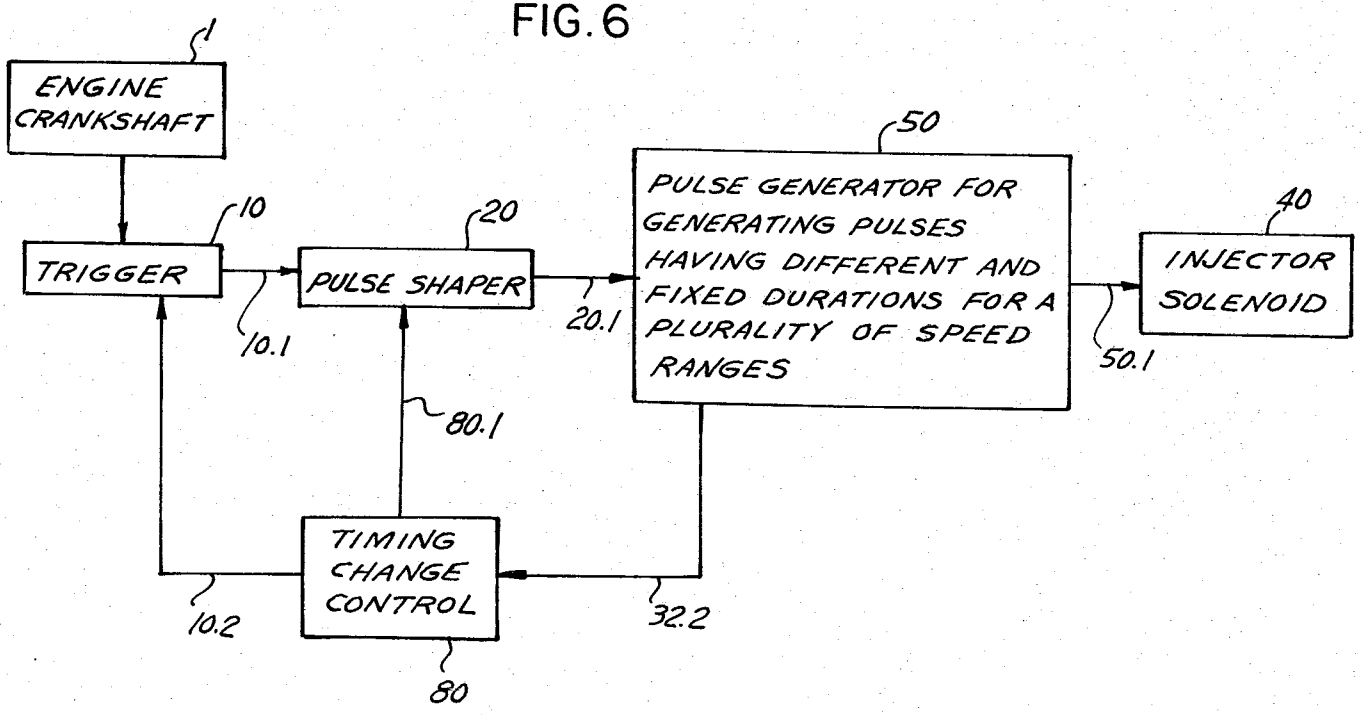

FIG. 6 illustrates a block diagram of a portion of another electronic control system for an internal combustion engine that utilizes additional features of the invention. This system provides signal pulses 50.1 to the circuitry that energizes one or more fuel injectors. Up to a predetermined maximum speed the signal pulses 50.1 have different and fixed durations for each of a plurality of crankshaft speed ranges. The operation of the individual blocks of the system, e.g., trigger 10, pulse shaper 20 and timing change control 80 is similar to that described for FIGS. 1 through 5. A functional illustration of pulse generator 50 is found in FIGS. 7, 8 and 9.

FIG. 7 illustrates in block diagram form how the versatility of the electronic control system shown in FIG. 1 is increased by the addition of another pulse generator 60 and a pulse duration selector comparator 51. In generaly, the pulse duration selector 51 compares the signal 30.1 from the first pulse generator 30 to the signal 60.1 from the second pulse generator 60 and takes the shorter of the two signals to control the duration of the control pulse to the injector solenoid and, hence, the amount of fuel injected into the engine by the solenoid. In this description the term fuel pulse is used to describe the duration during which an injector is supplying fuel to the engine. In this embodiment, to assure that the fuel pulse never exceeds a particular maximum number of engine crankshaft degrees of rotation and that the engine crankshaft speed never exceeds a particular maximum, a comparator 51 is used to compare the duration of a signal from the pulse generator 30, which establishes the maximums, to the duration of a pulse from a second pulse generator 60 and take the duration which is the smaller of the two as a resulting signal 50.1. The duration of the resulting signal 50.1 is always one which will not exceed the maximum established by the duration of the signal at 30.1 from the first pulse generator 30.

FIG. 8 illustrates in block form, a breakdown of the second pulse generator 60 is shown in FIG. 7. FIG. 8 is similar to that shown in FIG. 3 and includes a mono-stable multivibrator 61 that receives a ramp signal 68.1 from the tachometer circuit 68 to control the duration of the output pulses 60.1 of the multivibrator 60. If it is determined that there should be a plurality of speed ranges, for instance 0 to 300 rpm, 300 to 500 rpm, and 500 to 1,000 rpm (thru ranges) and each range should have a different pulse duration, the circuitry includes a fuel pulse adjust 69 and a fuel pulse adjustor comprised of blocks 62 through 67 shown in FIG. 9.

FIG. 9 illustrates further functional details of the block diagram shown in FIG. 8. FIG. 9 illustrates an arrangement of an electronic control system where there are three speed ranges each having a different and fixed duration fuel pulse in degrees of engine crankshaft rotation. In this embodiment, there is a summing circuit 62 which receives a signal 68.1 from the tachometer circuit 68 and from another summing circuit 63. Without a signal 63.1 from the additional summing circuit 63, the system would be operating in a first speed range. When there is a speed signal 67.1 from the second speed range block 67, comparator 64 and summing circuit 63 supplies a signal 63.1 to summing circuit 62 which then advances the electronic control system into the second speed range. The electronic control system will operate in the third speed range when there is a speed signal 66.1 from the third speed range by block 66. In this instance, comparator 65 then puts out a signal 65.1 to the summing circuit 62 which in turn causes the entire electronic control system to operate in the third speed range. The summing circuit 62 or 63 may be adding or difference amplifiers depending on the crankshaft duration angle chosen for a particular speed range. However, in this instance, summing circuit 62 and summing amplifier 63 are adding circuits.

FIGS. 10 and 12 are graphs illustrating engine crankshaft speed versus fuel pulse duration shown in FIGS. 1 through 5. The duration of the fuel pulse in FIG. 10 is in miliseconds and the duration of the fuel pulse in FIG. 12 is in engine crankshaft degrees of rotation. Referring now to FIG. 10, one axis is speed of the engine in rpm and the other axis is the duration of the fuel pulse in milliseconds. The fuel pulse or fuel "on" time is equal to the duration of the pulse from the generator 30 shown in FIG. 1. Lines L-1 and L-2 are called load lines. For a particular engine having a load L-1, the speed is determined by the time duration for which the fuel injector is energized. Therefore, an engine having a load L-1 will operate at the speed where line L-1 crosses Curve A. Conversely, an engine having a load L-2 will operate at a speed where line L-2 crosses line X. Line X being the maximum crankshaft speed above which the engine manufacturer does not want his engine to operate.

FIG. 12 illustrates how a particular engine will operate under particular loads L-1 and L-2 when the injector on-time is a fixed number of crankshaft degrees. When the engine has a first load identified by load by line L-1, the engine crankshaft will rotate at the speed where line L-1 crosses line A1. When the load of the engine is changed to a load identified by load line L-2, the speed of the engine will be determined by the point where L-2 crosses line X. When the engine is operating under a third load (line L-3) the speed of the engine will be determined by the point at which load line L-3 crosses line A1. Line A1 is established by the maximum fuel pulse adjust 35 shown in FIG. 3. Line X is established by the maximum speed limit signal 37 shown in FIGS. 4 and 5. In other words, line A1 represents the duration chosen by the maximum fuel pulse adjust circuit 35 for a particular engine. And, line X is the maximum speed at which the engine manufacturer does not want his engine to exceed and is established by the circuitry associated with block 37 in FIG. 5.

FIGS. 11 and 13 are graphs illustrating engine crankshaft speed versus fuel pulse duration for an electronic control system of the type shown in FIGS. 6 through 9. FIG. 11 relates crankshaft rpm to fuel on time in milliseconds and FIG. 13 relates crankshaft rpm to fuel on time in crankshaft degrees. Referring now to FIG. 11, there is shown three speed ranges, A, B, and C, and a maximum speed defined by line Y. Load line L-1 determines at what speed the engine crankshaft will rotate for a particular fuel on time in milliseconds. FIG. 13 illustrates the operational characteristics of an electronic control system having three speed ranges, A1, B1, and C1 which operate within speed range Y. FIG. 13 can best be understood in conjunction with FIG. 7. In FIG. 7, signal 30.1 establishes lines E and Y of FIG. 13. In FIG. 7, the signal 60.1 establishes lines A1, B1, and C1 in FIG. 13. Tracing the origin of Curve E back beyond FIG. 7, we see that Curve E is established by the maximum fuel pulse adjust 35 shown in FIG. 3 and Curve Y is established by the maximum speed limit signal shown in FIG. 5. Respectively, tracing back Curve A1, B1, C1, we see that the Curve A1 is established by summing circuit 62 in FIG. 9. The remaining lines are established by other summing circuits, such as circuit 63.

Figure 14:
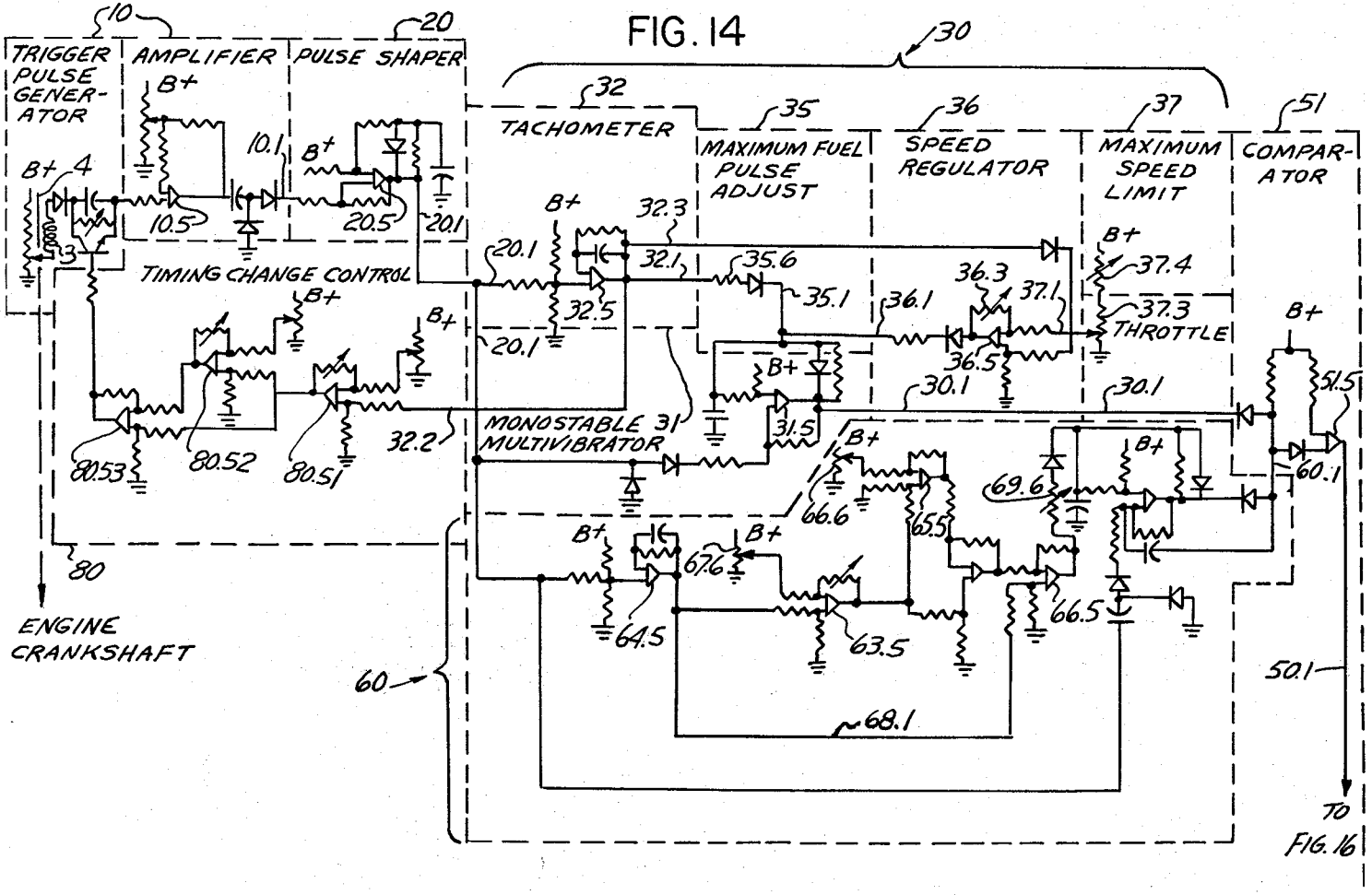
FIGS. 14, 15 and 16 illustrate the circuitry associated with the embodiment of the invention shown in FIGS. 1–9.
Figure 15:
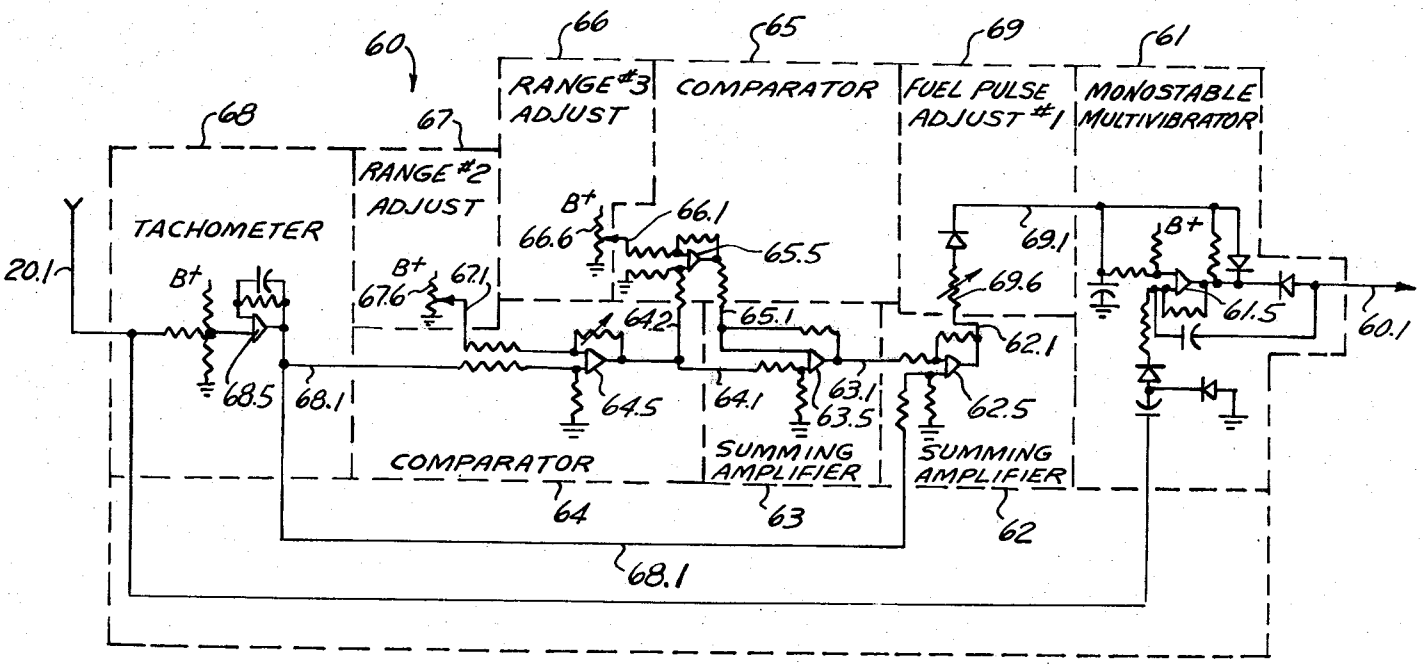
Figure 16:
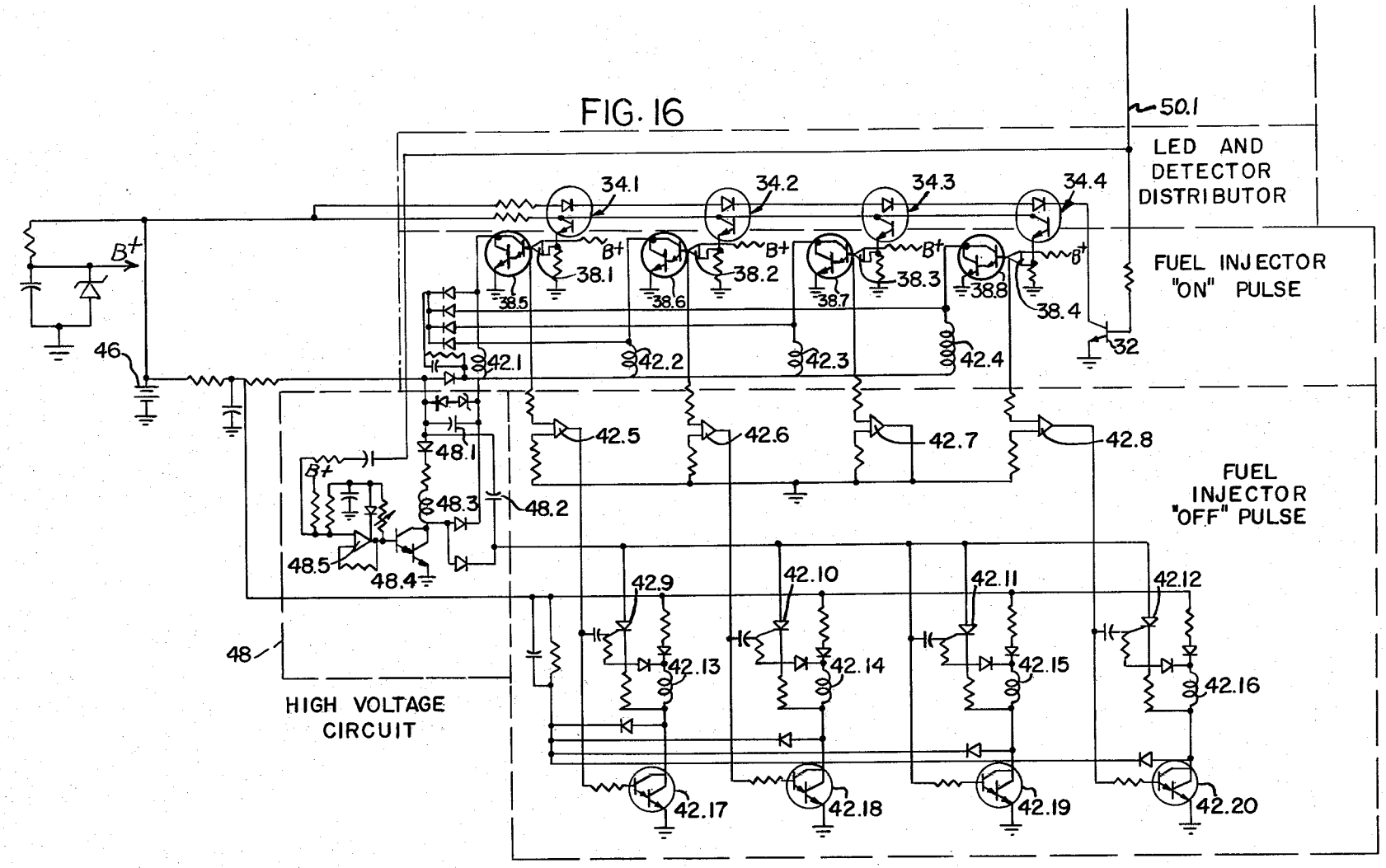

FIGS. 14, 15 and 16 illustrate the circuitry of the electronic control system that performs the functions described in the block diagrams shown in FIGS. 1 through 9. To facilitate an understanding of the circuitry, the input and output signals of each block diagram are identified on the schematics.

FIG. 14 shows the circuitry associated with the trigger pulse generator 10, the pulse shaper 20, the timing change control 80, the pulse generator 30, and comparator 51. Each trigger pulse signal generated by the electromagnetic trigger pulse generator 10 is amplified and the signal 10.1 is then shaped by pulse shaper 20 to give a rectangular output pulse 20.1. The output pulse 20.1 is then introduced into an engine speed tachometer 32 and a monostable multivibrator 31. As the engine speed of the engine crankshaft increases, the output of the tachometer 32 provides a linear DC ramp voltage signal 32.1 proportional to the engine speed (voltage vs. engine speed). The voltage signal 32.1 may be introduced into a signal pulse duration adjuster (maximum fuel pulse adjust) 35 before introducing the signal 32.1 into the monostable multivibrator 31 to establish a maximum (limit) pulse duration of the multivibrator output signal 30.1 and hence prevent the engine crankshaft from exceeding a predetermined maximum fuel amount as a result of operator throttle command or load changes. The duration of the signal pulse 30.1 from the multivibrator 31 controls the "ON" time of an injector and hence the amount of fuel which flows into the engine through the injector. The maximum fuel pulse adjust circuit 35 limits the fuel "ON" time to any of a plurality of predetermined number of engine crankshaft degrees for every crankshaft rotational speed depending on the value of resistor 35.6. Although the exact number of degrees is not crucial, it has been determined that a setting of 40° is a particularly good setting for engine performance and fuel economy. The fixed duration (in crankshaft degrees) of the signal (fuel) pulse 30.1 is accomplished by feeding a portion of the DC ramp output signal 32.1 of the tachometer 32 into the monostable circuit 31. The amount of DC ramp output signal 32.1 from the tachometer 32 to the monostable circuit 31 determines the fuel "ON" time in a specific predetermined number of crankshaft degrees. Resistor 35.6 of the maximum fuel pulse adjust circuit 35 sets the maximum number of crankshaft degrees for which fuel can be injected into the engine and hence it establishes the total engine speed range. For example, 10 to 500 rpm. Within the total range, there may be subranges, 0 to 100 rpm, 101 rpm to 300 rpm, and 301 rpm to 500 rpm adding up to the total range. For each subrange, a fixed number of crankshaft degrees of fuel duration can be established by adjusting the resistors 69.6 (first range), 67.6 (second range), and 66.6 (third range).

The speed regulator 36 and maximum speed limit circuit 37 provides a certain fuel pulse duration to sustain a given load at a given speed. This is similar to a governing action, for if the load changes once the throttle position is set, the fuel "ON" time will increase or decrease to change the amount of fuel delivered to the engine to maintain the desired speed. The maximum speed limit circuit 37 prohibits the engine from operating higher than a predetermined speed and is similar to employing a stop point on the governor. This maximum speed circuit 37 utilizes the tachometer ramp signal 32.3 as a reference and limits the maximum speed by reducing the fuel "ON" time (duration in crankshaft degrees that fuel is injected into the engine) above a predetermined speed.

Initiation of the "ON" time of the injector by the trigger pulse signal 20.1 in relation to the engine crankshaft position is called timing. A timing change control may be used to adjust the initiation of the trigger pulse 10.1 in relation to crankshaft speed and position to advance or retard the signal 50.1 to an injector. Since the trigger coil 3 employed in the present invention operates by changing magnetic flux to cause a pulse which increases in amplitude and duration with increasing speed, controlling the amplitude and duration of the pulse will control timing. As before, the output signal 32.2 of the tachometer circuit 32 is used to determine when timing should be adjusted and automatically adjusting the timing to that preset for optimum engine operation.

Operation of the circuit shown in FIG. 14 may be further described as follows. A pulse is produced by the trigger pulse generator 10 when a vane 4 of a paddlewheel, which is mechanically oriented to a predetermined position of the engine crankshaft firing position, rotates past the coil 3. The paddlewheel rotates in response to the rotation of the engine crankshaft and contains the same number of vanes as there are injectors so that each injector would be activated once for each engine operating cycle as a vane passes the coil. The pulse from the coil 3 is fed into a pulse shaper 20 after passing through an amplifier circuit which includes a capacitor and a variable resistor to amplify the pulse. The pulse shaper 20 includes a monostable multivibrator which is part of the integrated circuit amplifier 20.5 which provides an output signal 20.1 which is a rectangular pulse, the duration of which is constant in time but varies in crankshaft degrees as the speed of the engine increases.

The pulse signal 20.1 is fed to the tachometer 32 which includes an amplifier 32.5 and circuitry to provide a DC output signal 32.1 which is proportional to speed. This output signal 20.1 initiates fuel injection by turning on the monostable multivibrator 31 which provides the pulses that operate the injector solenoids. By adjusting the anount of DC ramp signal 32.1 fed to the monostable multivibrator 31, the fuel "ON" time may be limited to a fixed number of degrees of engine crankshaft revolution. This adjustment is accomplished by setting the value of a variable resistor 35.6 to a specific value. Ordinarily, the pulse duration of monostable output signal 30.1 would be constant on a time scale, but because DC current is being fed by the tachometer output signal 32.1 into the monostable multivibrator, the actual pulse duration decreases on a time scale as the engine crankshaft speed increases. However, on a crankshaft degree scale, the duration (in degrees) of the output pulse 30.1 is fixed as the engine crankshaft speed increases. This circuit allows the "ON" time of the fuel injectors to be limited to a certain predetermined number of degrees of engine crankshaft rotation (for example, 40°) regardless of the speed of the engine. Once this figure is inputted into the fuel control circuitry, the engine cannot receive fuel for a larger number of degrees regardless of load changes or operator throttle changes.

The maximum speed limit circuit 37 and speed regulator circuit 36 are used to control the operating speed of the engine crankshaft. The maximum speed limit is set into the device through the use of variable resistor 37.4. Potentiometer 37.3 is the throttle which is adjusted by the engine operator. In this manner, the maximum possible speed limit set by resistor 37.4 is the highest position of potentiometer 37.3. Both circuits 36 and 37 are controlled by integrated circuit amplifier 36.5 which includes a voltage level detector or comparator circuit which also receives a signal 32.3 from the tachometer 32 and signal 37.1 from the maximum speed limit circuit 37. If the voltage signal 37.1 is greater than the voltage signal 32.3 of the tachometer 32, there will be no output from the integrated circuit amplifier 36.5 and the duration of the monostable output signal 30.1 will be controlled only by the maximum fuel pulse adjust signal 35.1. If, however, the voltage level of signal 32.3 exceeds the voltage level of signal 37.1, the duration of the fuel pulse signal 30.1 will be controlled by both signal 35.1 and signal 36.1 to decrease the duration of the monostable output signal 30.1. The rate of decrease of the monostable output pulse 30.1 at the end of the speed range (see FIGS. 10–13, Curves X and Y) will be a function of the value of variable resistor 36.3 which determines the gain of amplifier 36.5. This circuitry, therefore, is the governor or speed regulator of the system.

With the engine operating at relatively high speeds or loads, the output signal 30.1 would be used to initiate the fuel "ON" time logic encompassed in comparator 51, which, in turn, activates the injector solenoids. However, at relatively low speeds and engine loads, the fuel pulse duration for example set at 40° of engine rotation, would be too great and provide too much fuel. In order to alleviate this problem, the maximum adjusted fuel circuitry 60 decreases the fuel pulse "ON" time to a lesser number of engine degrees. Additionally, engines are not built for full power at low speeds and to insure that power is limited, the fuel introduced to the injectors are likewise limited. At the same time, fuel enrichment is desired at starting so that more fuel is desired to start the engine than is required during idle conditions. Furthermore, with respect to diesel engines, although pressure of the jerk pump increases with speed, it is not a linear progression and therefore at low speeds, too much fuel would be injected.

Once the adjusted maximum fuel curve (FIG. 13, lines A1, B1 and C1) is determined for given engine speeds and loads, the values of the components in circuit 60 may be determined. Also, the circuitry 60 can be easily modified to the exact needs of a particular engine. As was true with regard to the discussion of the signal 30.1, signal 60.1 is also formed by circuitry making the signal 60.1 a function of degrees of crankshaft rotation.

FIG. 15 also shows the circuitry 60 for the electronic control system shown in FIGS. 6, 7, and 14 which provides additional speed ranges to the electronic control system shown in FIG. 1. The circuit 60 between signal 20.1 and signal 60.1 of FIG. 7 are shown in FIG. 15 and comprise a monostable multivibrator 61, a summing amplifier 62, a summing amplifier 63, a comparator 64, a comparator 65, a range #3 adjust 66, a range #2 adjust 67, a tachometer 68, and a fuel pulse adjust #1 67. The circuit 60 functions similar to that disclosed for circuit 30.

In operation, the output current signal 68.1 of the tachometer 68 feeds through amplifier 62.5 to the fuel pulse adjust 69 for the first range to establish a pulse signal 60.1 having a duration that is equal to a first fixed number of crankshaft degrees for the first speed range. As the speed of the engine crankshaft increases into speed range No. 2, comparator 64 increases the fixed duration in degrees of crankshaft rotation of the signal pulse 60.1 to the duration established by the second speed range circuitry. This occurs when the magnitude of the tachometer output signal 68.1 going into the comparator amplifier 64.5 equals the magnitude of the output signal 67.1 also going into the amplifier 64.5. The amplifier output signal 64.1 is then fed into amplifier 63.5 where it is added to signal 68.1 by amplifier 62.5 to provide the new output signal 60.1 for the second speed range. This second signal has a fixed duration (in degrees) different than the signal provided when the speed of the engine crankshaft is in the first speed range. Similarly, the comparator 65, which includes ingetrated circuit amplifier 65.5, provides the basic for the duration of the output pulse 60.1 in the third speed range.

In the circuitry shown in FIG. 14 and FIG. 15, integrated circuit quadamplifiers are used and are shown as a triangle. These quadamps are versatile and may be connected into circuitry as comparators as well as amplifiers. Each quadamplifier includes four amplifiers and the amplfier in each circuitry is identified by one of the following numbers: 10.5; 20.5; 31.5; 32.5; 36.5; 51.5; 63.5; 64.5; 66.5; 69.5; 80.51; 80.52; and 80.53. Quadamplifiers chosen by the inventor in the actual circuitry were RCA CA3401E, National 3900N or Motorola MC3301P.

FIG. 16 illustrates the remaining circuit to distribute the power to the individual injectors in timed relation to the operating cycle of the engine. Once the correct fuel duration and timing have been determined and are initiated, they are used to deliver fuel from the fuel injectors in the correct firing sequence. In this embodiment, this is accomplished by an optical distributor, the details of which are specifically described in U.S. patent application Ser. No. 908,479, entitled "Opto-Electronic Distributor for Breakerless Ignition", filed May 30, 1978. Other distributors, for example, mechanical, electromagnetic, etc., may also be used. In general, the optical distributor (34.1–34.4) consists of a plurality of light emitting diodes (LED) separated from detectors (transistors) by a rotating portion (not shown). The "ON" time pulse is amplified by amplifier 32 which activates the LEDs 34.1–34.4 (1 LED for each fuel injector). The rotating distributor 36 consists of a circular disc containing a single slot or window whereby at any one time only a single LED would transmit visual or infrared waves to its respective detector. The light from the remaining LEDs is blocked by the disc which rotates at the same speed as the engine crankshaft. The slot in the disc is mechanical, oriented to a piston position. Turning "ON" of detector 34.1 activates amplifier 38.1 and 38.5 to control the power which activates the proper fuel injector solenoid 42.1. Although it is not crucial to the present invention, the embodiment described herein utilizes two solenoids to control a single fuel injector. Once one of the detectors in the array is activated by its respective LED, the signal activates an "ON" solenoid for the fuel injector and simultaneously deactivates the "OFF" solenoid of the same fuel injector. At the conclusion of the "ON" time pulse, the LED in the detector turns off and the "OFF" solenoid of the injector turns on, positively deactivating the injector. For instance, to turn off the same injector, the solenoid 42.13 is energized by amplifier 42.5 and 42.17 which is activated by the turn off of detector 34.1. Similarly, detector 34.2 controls operation of the solenoids 42.2 and 42.14 through amplifiers 38.2 and 38.6 and amplifiers 42.6 and 42.18 respectively. And so on for each additional injector.

The power and fuel duration control circuit disclosed herein is supplied power from a battery 46 supplying 24 volts. Since the solenoid rise time for 24 volt power souce is relatively slow, a high voltage source 48 supplies additional power of approximately 68 volts through a push-pull circuit to accelerate the rise time of the "ON" and "OFF" solenoids. Therefore, the total power supply to each solenoid is approximately 92 volts.

The output signal 50.1 turns on all of the LEDs but only when the slot or window passes between a LED and its respective darlington transistor circuit (detector) will the transistor be activated for the length of the signal pulse 50.1. If the slot or window were at 34.1 when signal 50.1 was present, the LEDs are activated, the transistor of 34.1 conducts, turning on amplifier 38.1 and transistor 38.5 allowing the conductor to conduct into injector solenoid 42.1, turning on the fuel injector. Inductors 42.2, 42.3 and 42.4 are activated in a similar manner through the use of transistors 38.6, 38.7 and 38.8 as well as integrated circuits 38.2, 38.3 and 38.4 Simultaneous to the conduction in inductor 42.1, the output of 38.1 turns off 42.5 and transistor 42.17 so that the current ceases to flow in inductor 42.13 which is the "OFF" solenoid of the same injector. At the end of the "ON" time pulse, the output of comparator 50.1 goes to zero turning off transistor 32, the optical switch 34.1, 38.1 and transistor 38.5 and reapplying power to 42.13 by way of 42.5 and transistor 42.17. In a similar manner, amplifiers 42.6, 42.7, 42.8, transistors 42.20, 42.19, and 42.18 as well as inductors 42.16, 42.15 and 42.14 turn off the "OFF" solenoid when the fuel is to be applied to a particular fuel injector. The slot or window of the distributor continues to rotate and will be in position for the next injection pulse when the trigger coil P1 activates the fuel control electronics once again.

It has been noted, however, that when a standard 24 volt battery is used as a power source, the rise time for the "ON" and "OFF" solenoids was slower than desired. Several speed-up techniques can be used, all of which apply a higher voltage and/or current than the rated value for a short duration of time to initially actuate the solenoid. The majority of these techniques developed an initiation voltage for solenoids which were activated for a relatively long period of time. However, when both "ON" and "OFF" solenoids are used for a single injector, there is little time to develop an initiation voltage to turn off the "OFF" solenoids if there is only a short "ON" pulse. Further problems arise when it is realized that for an eight cylinder system, it may take 16 amps of steady state current at 24 volts to operate in this mode of operation; a significant amount of power required and a considerable amount of heat to dissipate. The circuit developed for this operation utilizes a pushpull effect to produce a high voltage initiation pulse of 68 volts for both solenoids, which when added to the battery voltage of 24 volts supplied a total voltage of approximately 92 volts to the solenoids. Immediately prior to the initiation of the fuel "ON" pulse, both capacitors 48.1 and 48.2 are fully charged to 68 volts. When transistor 32 turns on by activation of the fuel "ON" pulse, both capacitors 48.1 and 48.2 are fully charged to 68 volts. When transistor 32 turns on by activation of the fuel "ON" pulse, capacitor 48.1 discharges into either inductors 42.1, 42.2, 42.3, or 42.4 to turn on its respective fuel solenoid thereby speeding up the rise time. When the "ON" pulse from transistor 32 is over, one of the silicon controlled rectifiers 42.9, 42.10, 42.11 or 42.12 corresponding to the current fuel "OFF" solenoid is triggered allowing capacitor 48.2 to discharge into the correct inductor. If, for example, inductor 42.1 is to be initiated, capacitor 48.1 would discharge into 42.1 and capacitor 48.2 would discharge into inductor 42.13 after silicon controlled rectifier 42.9 is triggered. SCR 42.9 turns off after the discharge because it becomes reverse biased when transistor 48.4 turns on. Both transistor 48.4 and integrated circuit 48.5 turn on at the beginning of the "OFF" pulse to send current through inductor 48.3 until a predetermined current level is reached at which time IC 58.4 and transistor 48.4 turns off. The turn off of 48.5 breaks current in inductor 48.3 and induces a voltage in capacitor 48.1 and 48.2 of 68 volts for the next initiation of the solenoids.

It is to be understood that the above-described arrangement is merely illustrative of the principals of the invention. While a particular embodiment of the present invention has been described and illustrated, it will be apparent to those skilled in the art that changes and modifications may be made therein without departure from the spirit and scope of the invention as claimed.

What is claimed is:

1. A system for controlling a solenoid operated fuel injector of an internal combustion engine of the type having a crankshaft which rotates during the operating cycle of the engine, said circuit comprising:

first means for generating a trigger pulse for each operating cycle of said engine; and second means, responsive to each trigger pulse, for generating an energizing pulse to energize the injector solenoid for each operating cycle of the engine, said second means including:

means for limiting the duration of said energizing pulse to a fixed number of degrees of engine crankshaft rotation over a preselected range of rotational speeds of said engine crankshaft, said limiting means consisting of electronic circuitry.

2. The system for controlling a solenoid operated fuel injector as recited in claim 1 wherein said means for limiting the duration of said energizing pulse comprises:

means for generating a first signal, the magnitude of which increases as the rotational speed of the engine crankshaft increases; and a monostable multivibrator responsive to each trigger pulse for providing a control pulse, said monstable multivibrator having means for receiving said first signal to control the duration of said control pulse, whereby said control pulse duration is controlled by said first signal to provide a control pulse duration which is a fixed number of degrees of engine crankshaft rotation over a preselected range of rotational speeds of said engine crankshaft.

3. The circuit recited in claim 1 wherein said means for limiting the duration of said energizing pulse further includes:

means for providing a pulse having a fixed duration in degrees of engine crankshaft rotation for each of a plurality of ranges of engine crankshaft speeds and wherein the fixed duration of said pulse is different for each of said different speed ranges.

4. The circuit recited in claim 2 wherein said means for limiting the duration of said energizing pulse further includes:

means for providing a pulse having a fixed duration in degrees of engine crankshaft rotation for each of a plurality of ranges of engine crankshaft speeds and wherein the fixed duration of said pulse is different for each of said different speed ranges.

5. The system for controlling a solenoid operated fuel injector as recited in claim 1, 2, 3 or 4 wherein said means for generating a trigger pulse for each operating cycle of the engine includes means for initiating the trigger pulse at the same specific engine crankshaft angle for each operating cycle of said engine; and means for automatically varying the initiation of said trigger pulse from said specific engine crankshaft as a function of an engine operating parameter.

6. The system for controlling a solenoid operated fuel injector as recited in claim 1, 2, 3 or 4 including:

means for preventing the speed of the engine crankshaft from exceeding a predetermined speed.

7. A system for controlling a solenoid operated fuel injector for an internal combustion engine of the type having a crankshaft which rotates during the operating cycle of the engine, said system comprising:

means for generating a trigger pulse for each operating cycle of said engine;

means for generating a first signal pulse in response to each trigger pulse over a preselected range of engine crankshaft rotational speeds, said first signal pulse having a duration in degrees of crankshaft angle rotation that is fixed;

means for generating a second signal pulse in response to each trigger pulse over said preselected range of engine crankshaft rotational speeds, said second signal pulse having a duration in degrees of engine crankshaft rotation that varies as a function of the rotational speed of the engine crankshaft; and means for generating an energizing pulse to energize said fuel injector solenoid in response to each trigger pulse, said pulse generating means including:

means responsive to each trigger pulse, for comparing the duration of said first signal pulse to the duration of said second signal pulse and generating an energizing pulse, having a duration equal to the shorter duration of said compared pulses, whereby said fuel injector is controlled in relation to the operating cycle of the engine by said energizing pulse.

8. A system recited in claim 7 wherein said means for generating a first signal pulse includes:

means for providing a pulse having a fixed duration for each of a plurality of ranges of engine crankshaft speeds and wherein the fixed duration of said pulse is different for each of said different speed ranges.

9. The system recited in claim 7 or 8 wherein said means for generating said first signal pulse comprises:

means for generating a ramp signal, the magnitude of which increases as the rotational speed of the engine crankshaft increases; and a monostable multivibrator responsive to each trigger pulse for providing a control pulse, said monostable multivibrator having means for receiving said ramp signal to control the duration of said control pulse, whereby said control pulse duration is controlled by said ramp signal to provide a control duration which is a fixed number of degrees of engine crankshaft rotation over a preselected range of rotational speeds of said engine crankshaft.

10. A system for controlling a solenoid operated fuel injector of an internal combustion engine of the type having a crankshaft which rotates during the operating cycle of the engine, said system comprising:

means for generating a trigger pulse for each operating cycle of said engine; and signal pulse generating means responsive to each trigger pulse for generating a signal pulse to energize the injector solenoid for each operating cycle of the engine, said signal pulse having a different and fixed duration in engine crankshaft degrees for each of a plurality of speed ranges of said engine crankshaft.

11. The system described in claim 10 including:

means for limiting the duration of said signal pulse at predetermined engine crankshaft speeds within at least one of said speed ranges.

12. The circuit recited in claim 11 wherein the means for limiting the duration of said signal pulses includes:

second pulse generating means responsive to said trigger pulses for generating pulses having a duration in degrees of engine crankshaft rotation which vary as a function of engine speed; and comparator means for comparing the duration of a pulse from said second pulse generating means to the duration of a pulse from said signal pulse generating means and providing an output pulse to said injector which has a duration equal to the shorter of the compared durations.

13. The system described in claim 12, including:

means for limiting the duration of said second pulse at predetermined crankshaft speeds within said speed ranges.

14. A system for controlling a solenoid operated fuel injector for an internal combustion engine of the type having a crankshaft which rotates during the operating cycle of the engine, said system comprising:

means for generating a trigger pulse for each operating cycle of the engine;

means for generating a reference signal pulse in response to each trigger pulse, said reference signal pulse having a first duration that corresponds to a first fixed number of engine crankshaft degrees over a first preselected range of engine crankshaft rotational speeds and a second duration that corresponds to a second and different fixed number of engine crankshaft degrees over a second and different preselected range of engine crankshaft rotational speeds;

means for generating a control signal pulse in response to each trigger pulse over said first and second preselected ranges of engine crankshaft rotational speeds, said control pulse having a duration in engine crankshaft degrees of rotation that varies as a function of the rotational speed of the engine crankshaft; and means for generating an energizing pulse for said fuel injector solenoid in response to each trigger pulse to inject fuel into the engine for each operating cycle of the engine, said energizing pulse generating means including:

means responsive to each trigger pulse for comparing the duration of a reference signal pulse to the duration of a control signal pulse and generating an energizing pulse, said energizing pulse having a duration equal to the shorter duration of said compared pulses, whereby when said energizing pulse is delivered to said fuel injector said fuel injector is energized.

15. The system for controlling a solenoid operated fuel injector as recited in claim 14 wherein said means for generating a signal pulse in response to each trigger pulse over said first and second preselected ranges of engine crankshaft rotational speeds includes:

means for generating a first signal, the magnitude of which increases as the engine crankshaft increases; and a monostable multivibrator responsive to each trigger pulse for providing a control pulse, said monostable multivibrator having means for receiving said first signal to control the duration of said control pulse, whereby said control pulse duration is controlled by said first signal to provide a control pulse duration which is fixed number of degrees of engine crankshaft rotation over a preselected range of rotational speeds of said engine crankshaft.

16. The system for controlling a solenoid operated fuel injector as recited in claim 14 wherein said means for generating a trigger pulse for each operating cycle of the engine includes means for initiating the trigger pulse at the same specific engine crankshaft angle for each operating cycle of said engine; and means for automatically varying the initiation of said trigger pulse from said specific engine crankshaft angle as a function of engine crankshaft speed.

17. The system for controlling a solenoid operated fuel injector as recited in claim 15 wherein said means for generating a trigger pulse for each operating cycle of the engine includes means for initiating the trigger pulse at the same specific engine crankshaft angle for each operating cycle of said engine; and means for automatically varying the initiation of said trigger pulse from said specific engine crankshaft angle as a function of engine crankshaft speed.

18. The system as recited in claim 14, 15, 16, or 17 wherein the system includes a plurality of fuel injectors; a plurality of trigger pulses and energizing pulses, each equal to the number of cylinders in the engine and generated for each operating cycle of the engine; and means for distributing said energizing pulses in a predetermined sequence to the fuel injectors during each operating cycle of the engine.

19. The system recited in claim 14, 15, 16 or 17 including means for limiting the duration of said control pulse at certain predetermined engine speeds.

20. A system for controlling a solenoid operated fuel injector in timed relation to the operating cycle of an internal combustion engine of the type having a crankshaft which rotates during the operating cycle of the engine, said system comprising:

means for generating a trigger pulse for each operating cycle of said engine;

means for generating a first signal pulse, in response to each trigger pulse, over a preselected range of engine crankshaft rotational speeds, said first signal pulse having a duration in degrees of crankshaft angle rotation that is fixed;

means for generating a second signal pulse, in response to each trigger pulse, over said preselected range of engine crankshaft rotational speeds, said second signal pulse having a duration in degrees of engine crankshaft rotation that varies as a function of the rotational speed of the engine crankshaft;

means for generating a speed signal, in response to said trigger pulse, which is a function of the rotational speed of said engine crankshaft;

means, responsive to said speed signal, for eliminating the pulses from said second signal pulse generator above a preselected rotational speed of said engine crankshaft; and means for generating an energizing pulse for energizing said fuel injector solenoid, in response to each trigger pulse, to inject fuel into the engine for each operating cycle of the engine, said pulse generating means including:

means, responsive to each trigger pulse and said speed signal for comparing the duration of said first signal pulse to the duration of said second signal pulse and generating an energizing pulse, said energizing pulse having a duration equal to the shorter duration of said compared pulses when there are two pulses to be compared and a duration equal to the duration of said first signal pulse when only one signal pulse is received, whereby said fuel injector is actuated when said fuel injector solenoid receives said energizing pulse.

21. The circuit described in claim 20 wherein said first signal pulse generating means comprises:

means for generating a first signal, the magnitude of which increases as the rotational speed of the engine crankshaft increases; and a monostable multivibrator responsive to each trigger pulse for providing a first signal pulse, said monostable multivibrator having means for controlling the duration of said first signal pulse which includes means for receiving said first signal to control the duration of said first signal pulse, whereby said first signal pulse duration is controlled by said first signal to provide a control pulse duration which is a fixed number of degrees of engine crankshaft rotation over a preselected range of engine speeds.

* * * * *